US011350725B2

(12) United States Patent
Simon Niada Stanton Yonge

(10) Patent No.: US 11,350,725 B2
(45) Date of Patent: Jun. 7, 2022

(54) AUTO-FOLDABLE POUCH

(71) Applicant: Felipe Simon Niada Stanton Yonge, Santiago (CL)

(72) Inventor: Felipe Simon Niada Stanton Yonge, Santiago (CL)

( * ) Notice: Subject to any disclaimer, the term of this patent is extended or adjusted under 35 U.S.C. 154(b) by 0 days.

(21) Appl. No.: 17/144,100

(22) Filed: Jan. 7, 2021

(65) Prior Publication Data

US 2021/0204677 A1 Jul. 8, 2021

Related U.S. Application Data

(60) Provisional application No. 62/958,185, filed on Jan. 7, 2020.

(51) Int. Cl.
*A45F 3/00* (2006.01)
*A45C 13/10* (2006.01)

(52) U.S. Cl.
CPC ..... *A45F 3/005* (2013.01); *A45C 13/103* (2013.01); *A45F 2200/0516* (2013.01)

(58) Field of Classification Search
CPC ..... A45F 3/005; A45C 11/26; A45C 13/103; A45C 2200/0516; A45C 1/04; Y10S 206/825
USPC ..... 224/664, 587
See application file for complete search history.

(56) References Cited

U.S. PATENT DOCUMENTS 4,446,574 A * 5/1984 Kalomeris ..... A45C 1/04 2/247
5,003,634 A * 4/1991 Brinkman ..... A41D 13/0537 2/253
5,102,216 A * 4/1992 Mitchell ..... G02C 3/003 206/5
5,209,385 A * 5/1993 Ledesma ..... A45C 1/04 224/223
5,540,366 A * 7/1996 Coomber ..... A41F 9/002 224/587
6,698,636 B2 * 3/2004 Angus ..... A45F 3/00 224/660
8,104,654 B2 * 1/2012 Overton ..... A45F 3/14 224/581
D802,915 S * 11/2017 Willows ..... D3/226
10,986,886 B2 * 4/2021 Willows ..... A45C 13/1023
2021/0120928 A1 * 4/2021 Dona ..... A45C 11/04

* cited by examiner

*Primary Examiner* — Adam J Waggenspack
(74) *Attorney, Agent, or Firm* — Charlena Thorpe, Esq.; Incorporating Innovation LLC

(57) ABSTRACT

Implementations of an auto-foldable pouch are provided. In some implementations, the auto-foldable pouch comprises an auto-foldable portion and a closure portion that form a pouch enclosure that can receive and hold an item.
In some implementations, a method of using the auto-foldable pouch comprises unrolling the pouch, opening the pouch, inserting one or more items into the pouch, and closing the pouch to securely hold and enclose the items.

9 Claims, 16 Drawing Sheets

AUTO-FOLDABLE POUCH

CROSS REFERENCE TO RELATED APPLICATION

This application claims the benefit of U.S. Patent Application Ser. No. 62/958,185, which was filed on Jan. 7, 2020, and is incorporated herein by reference in its entirety.

TECHNICAL FIELD

This disclosure relates to implementations of an auto-foldable pouch.

BACKGROUND

As shown in FIG. 1A, existing pouch enclosures are usually configured to hold one or more portable items such as a cell phone and/or typical pocket contents such as a wallet, keys, etc. Such pouch enclosures usually include an opening for inserting the items and a fastener for closing the opening. Such pouch enclosures may also include a belt or other connector for carrying the pouch enclosures while holding such items. However, such pouch enclosures can be bulky when empty or partially filled with items, making the pouch enclosures difficult or otherwise undesirable to carry or to store conveniently.

As shown in FIG. 1B and disclosed for example in U.S. Pat. No. 5,102,216, there exist auto-foldable configurations of material for holding portable items. Such auto-foldable configurations of material can auto-fold (e.g., self-fold or self-compact) to make such configurations less bulky and more compact when empty or partially filled with items. However, such auto-foldable configurations of material do not provide an auto-foldable pouch enclosure that includes an enclosing portion that is separate from the auto-foldable portion of material. Furthermore, such auto-foldable configurations of material do not provide an auto-foldable pouch enclosure that includes a fastener that closes an opening of the pouch enclosure through such separate enclosing portion to securely hold and enclose items.

DETAILED DESCRIPTION

Implementations of an auto-foldable pouch are provided. In some implementations, the auto-foldable pouch comprises an auto-folding portion, an enclosing portion, an opening, and a closure ("fastener"). In some implementations, the auto-foldable pouch may further comprise a connector.

In some implementations, the auto-foldable pouch is configured to provide an auto-foldable pouch enclosure that includes an enclosing portion that is separate from the auto-folding portion.

In some implementations, the auto-foldable pouch is also configured to provide an auto-foldable pouch enclosure that includes a fastener that closes an opening of the pouch enclosure through the separate enclosing portion to securely hold and enclose items.

In some implementations, the auto-foldable pouch is configured to auto-fold (e.g., self-fold or self-compact). For example, in some implementations, the auto-foldable pouch is configured to normally roll up or otherwise fold into a compact configuration.

In some implementations, the auto-foldable pouch is configured to allow items to be inserted into and removed from the auto-foldable pouch, such as a cell phone and/or other typical pocket contents such as a wallet, keys, etc.

In some implementations, the auto-foldable pouch is configured to be closed by a fastener to securely hold and enclose items in the auto-foldable pouch. In some implementations, the auto-foldable pouch is configured to be opened by the fastener to remove the items held and enclosed in the auto-foldable pouch.

In some implementations, the auto-foldable pouch is configured to allow a user to carry the auto-foldable pouch.

In some implementations, the auto-foldable pouch is configured to allow a user to carry the auto-foldable pouch on-person, such as attached around the user's waist.

In some implementations, the auto-foldable pouch is configured to allow a user to attach the auto-foldable pouch to a pair of eyeglasses or sunglasses.

In some implementations, an example method of using the auto-foldable pouch comprises unrolling or otherwise unfolding the auto-foldable pouch. In some implementations, the method comprises opening the auto-foldable pouch for the insertion of one or more items into the auto-foldable pouch.

In some implementations, the method comprises inserting one or more items into the auto-foldable pouch through the opening. In some implementations, the method comprises closing the auto-foldable pouch to securely hold and enclose the items in the auto-foldable pouch.

In some implementations, the method further comprises carrying the auto-foldable pouch containing the items with the connector.

Figure 1A:
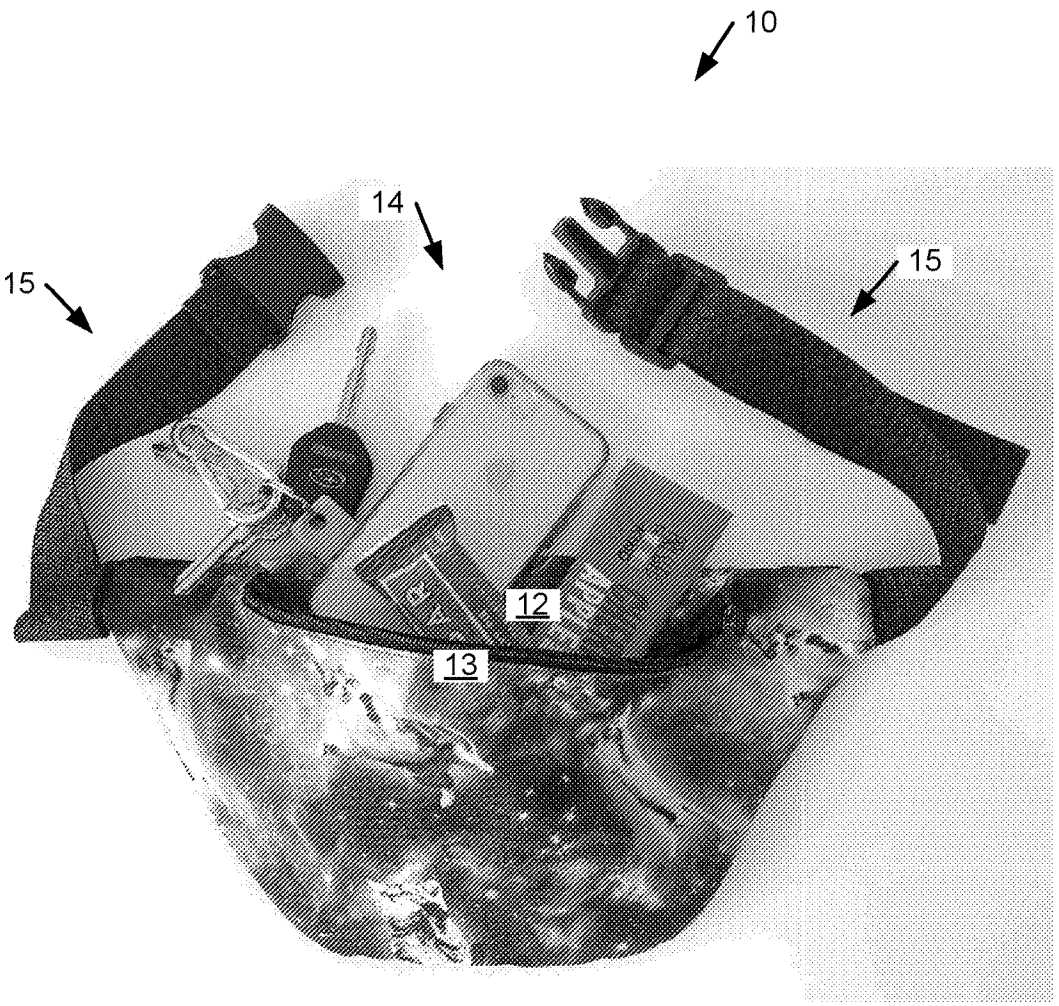
FIG. 1A (PRIOR ART)
FIG. 1A illustrates an example existing pouch enclosure.

As shown in FIG. 1A, existing pouch enclosures 10 are usually configured to hold one or more portable items 14 such as a cell phone and/or typical pocket contents such as a wallet, keys, etc. Such pouch enclosures 10 usually include an opening 12 for inserting the items 14 and a fastener 13 for closing the opening 12. Such pouch enclosures 10 may also include a belt 15 or other connector for carrying the pouch enclosures 10 while holding such items 14. However, such pouch enclosures 10 can be bulky when empty or partially filled with items 14, making the pouch enclosures 10 difficult or otherwise undesirable to carry or to store conveniently.

Figure 1B:
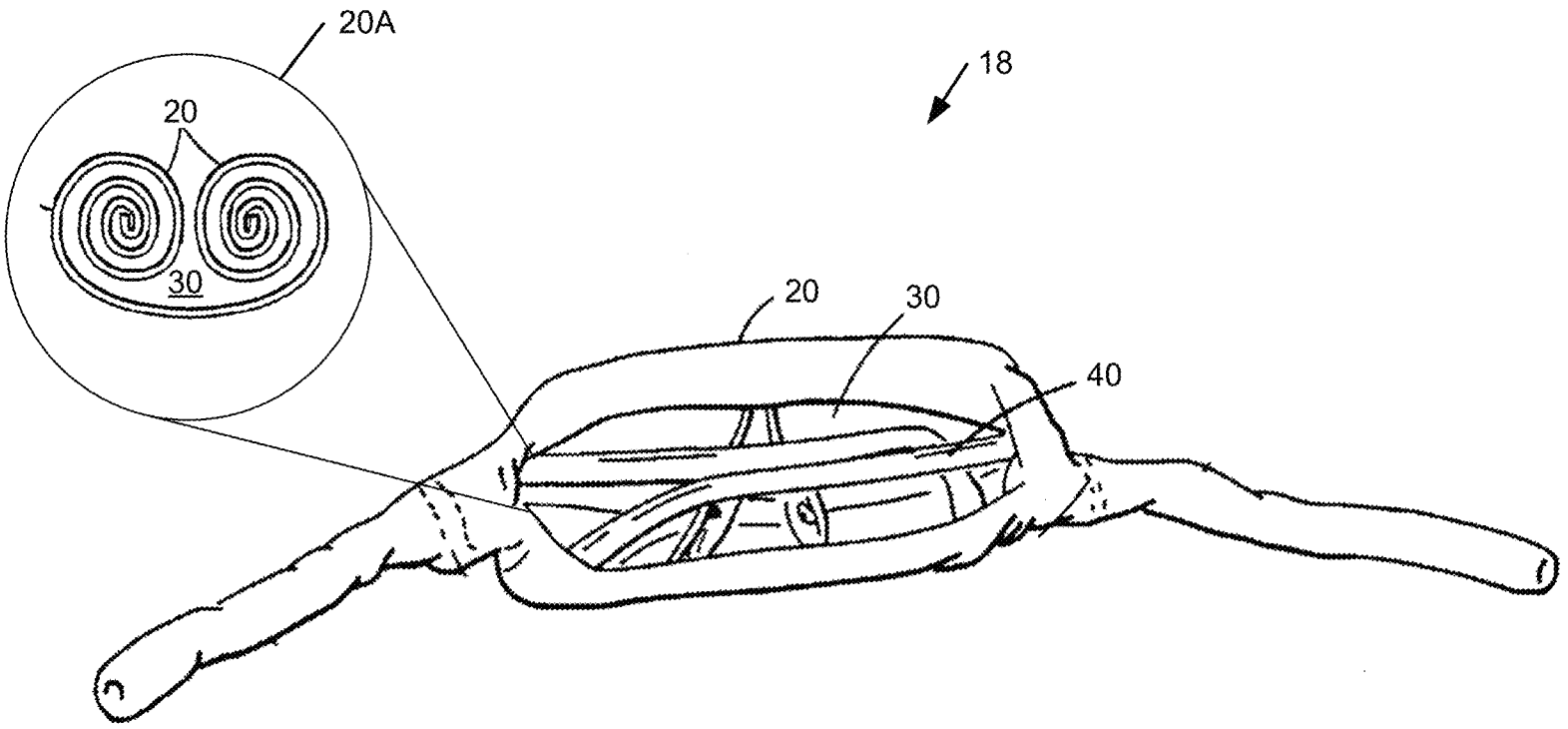
FIG. 1B (PRIOR ART)
FIG. 1B illustrates an example auto-foldable configuration of material.

As shown in FIG. 1B and disclosed for example in U.S. Pat. No. 5,102,216, there exist auto-foldable configurations 18 of material 20 for forming a cavity 30 to hold portable items 40. As shown by the zoomed-in view 20A in FIG. 1B, such auto-foldable configurations 18 of material 20 can auto-fold (e.g., self-fold or self-compact) to make such configurations 18 less bulky and more compact when empty or partially filled with items 40. However, such auto-foldable configurations 18 of material 20 do not provide an auto-foldable pouch enclosure that includes an enclosing portion that is separate from the auto-foldable portion of material. Furthermore, such auto-foldable configurations 18 of material 20 do not provide an auto-foldable pouch enclosure that includes a fastener that closes an opening of the pouch enclosure through such separate enclosing portion to securely hold and enclose items.

FIGS. 2A-2H illustrate various front or top views and FIGS. 2I-2L illustrate various back or bottom views of an implementation of an example auto-foldable pouch 100 according to the present disclosure.

Figure 2A:
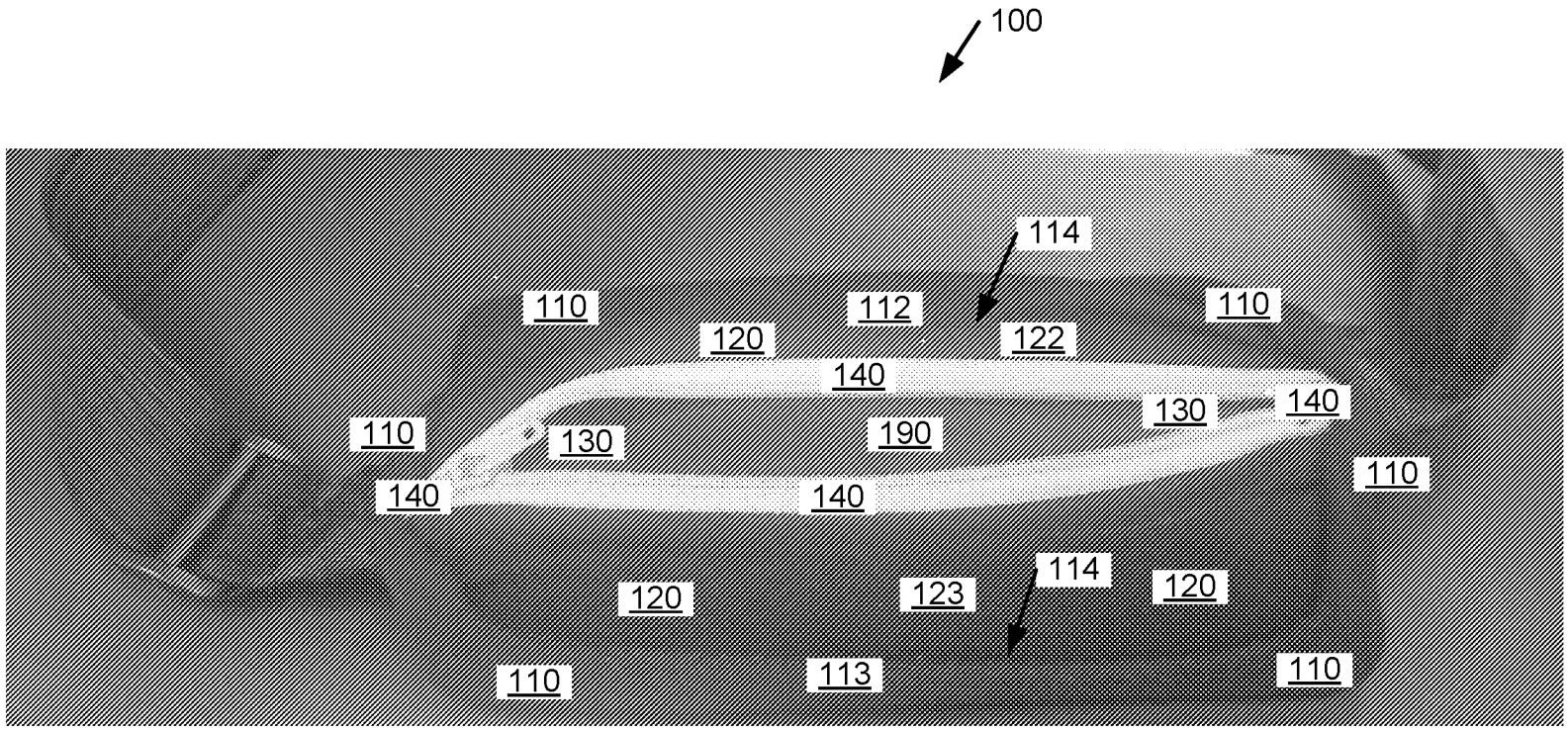
FIGS. 2A-2H illustrate various front or top views of an implementation of an example auto-foldable pouch according to the present disclosure.
Figure 2B:
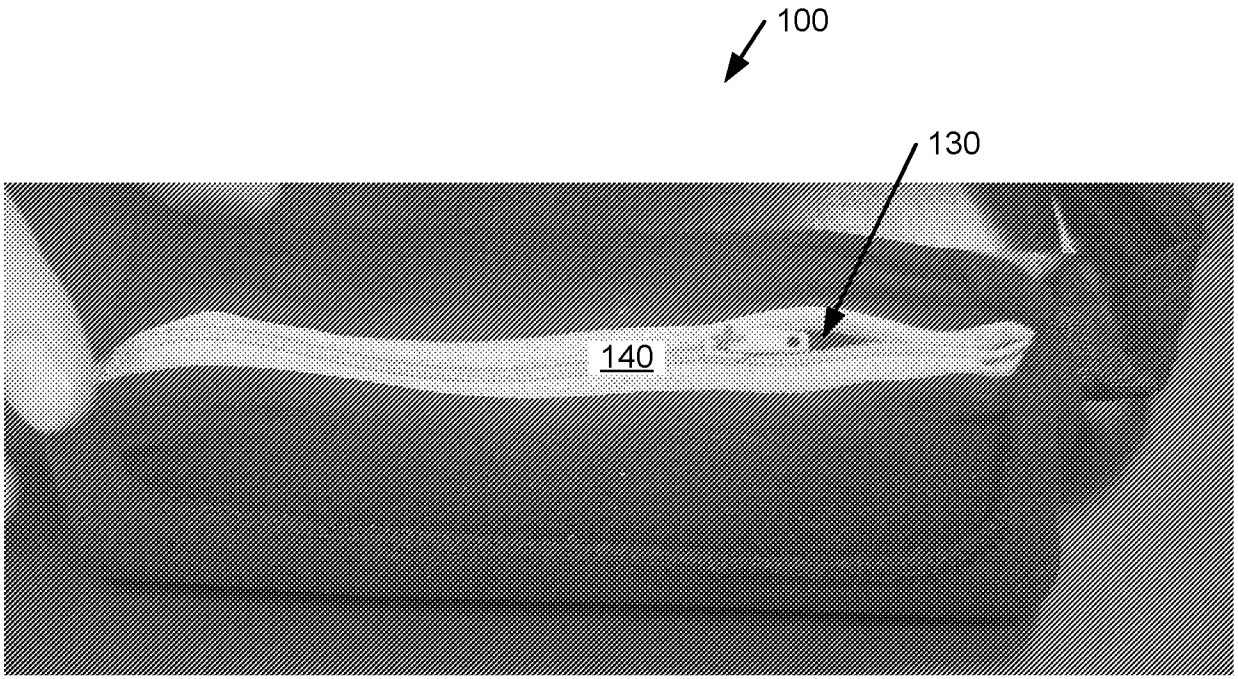
Figure 2C:
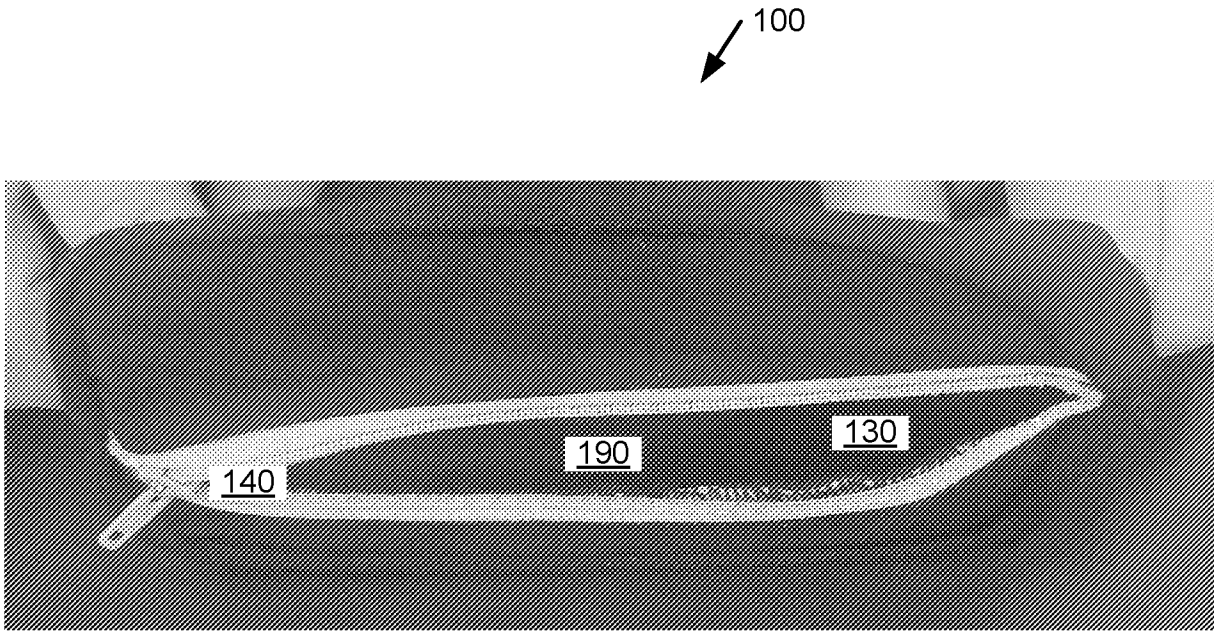
Figure 2D:
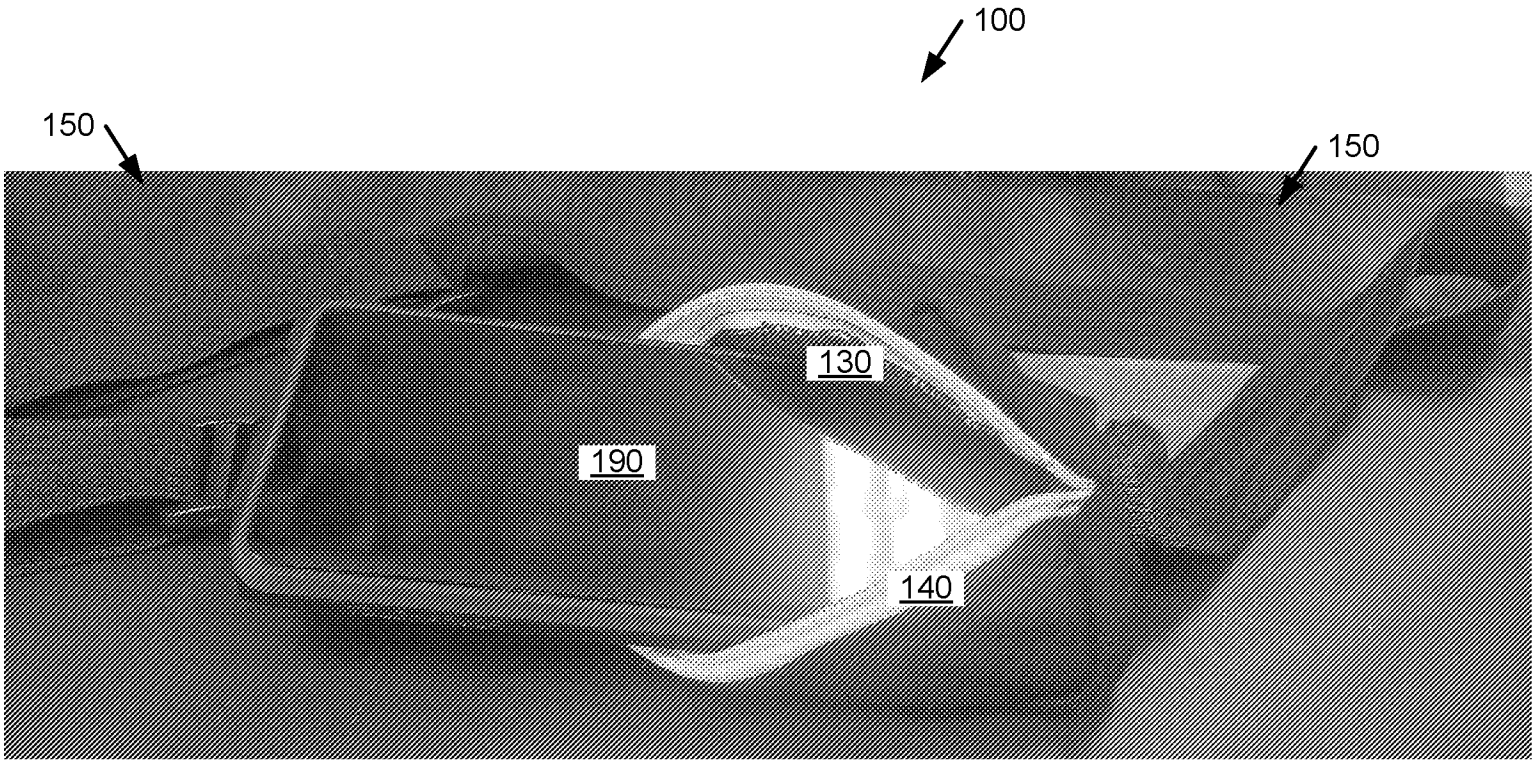
Figure 2E:
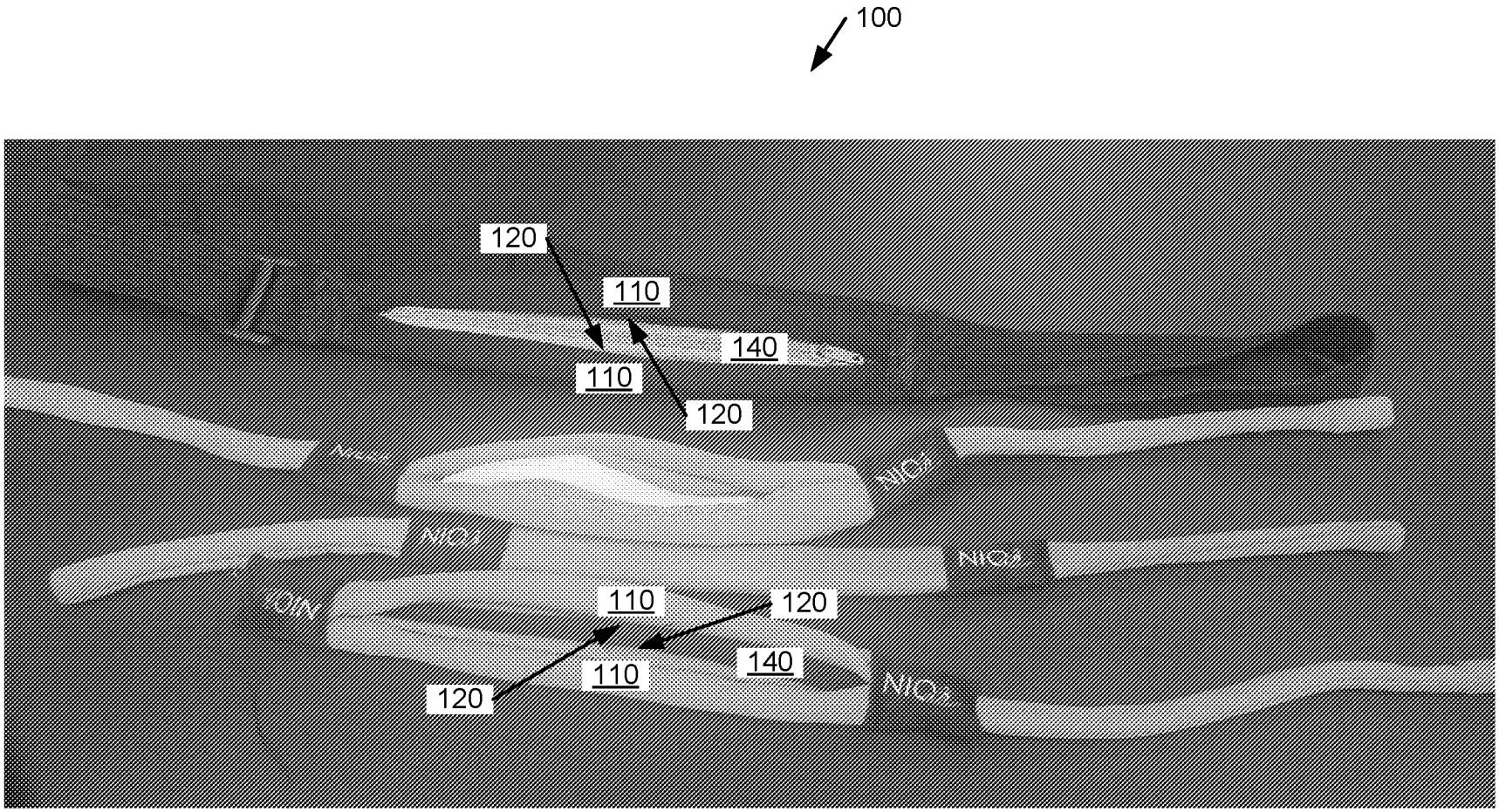
Figure 2F:
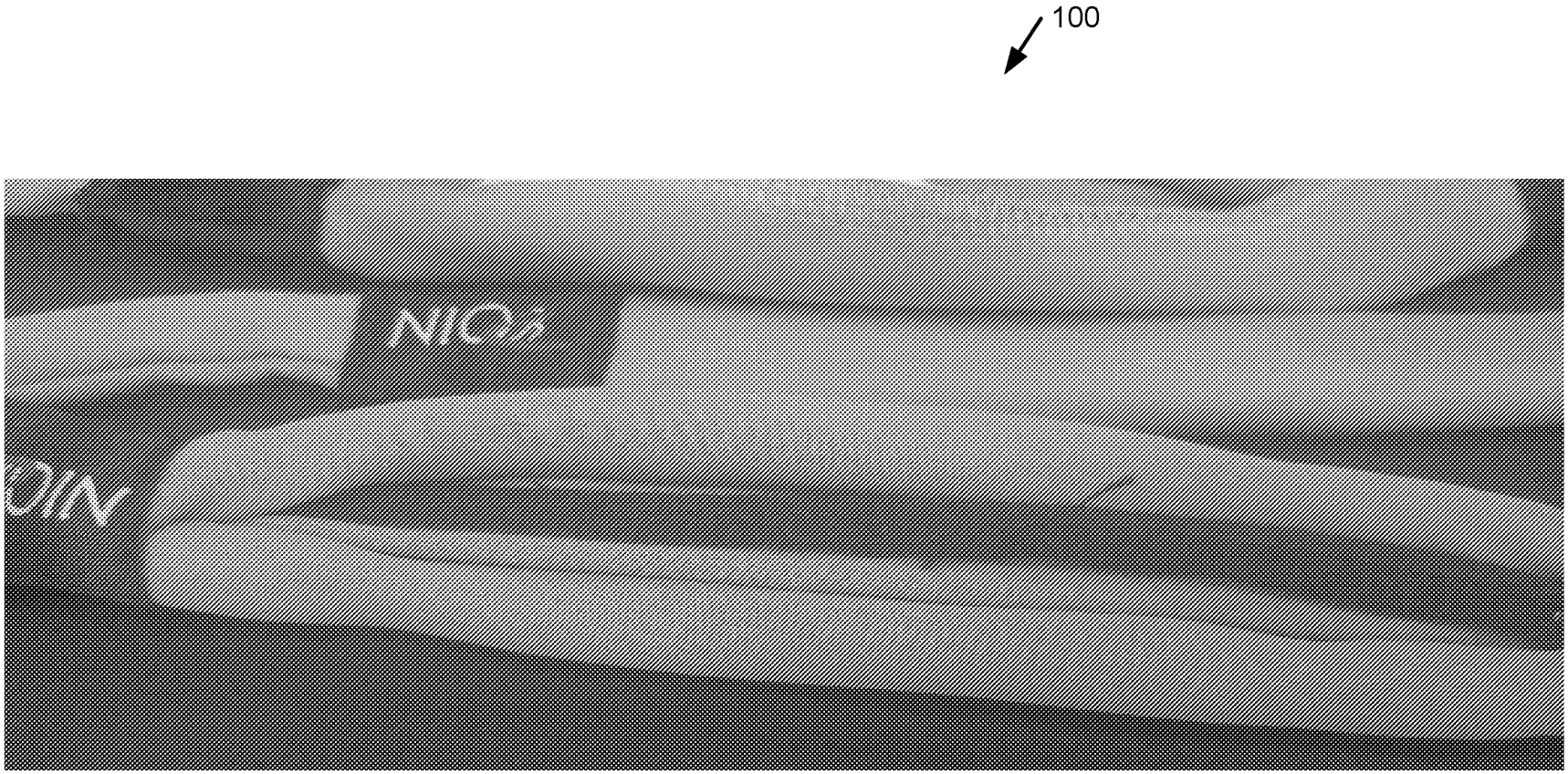
Figure 2G:
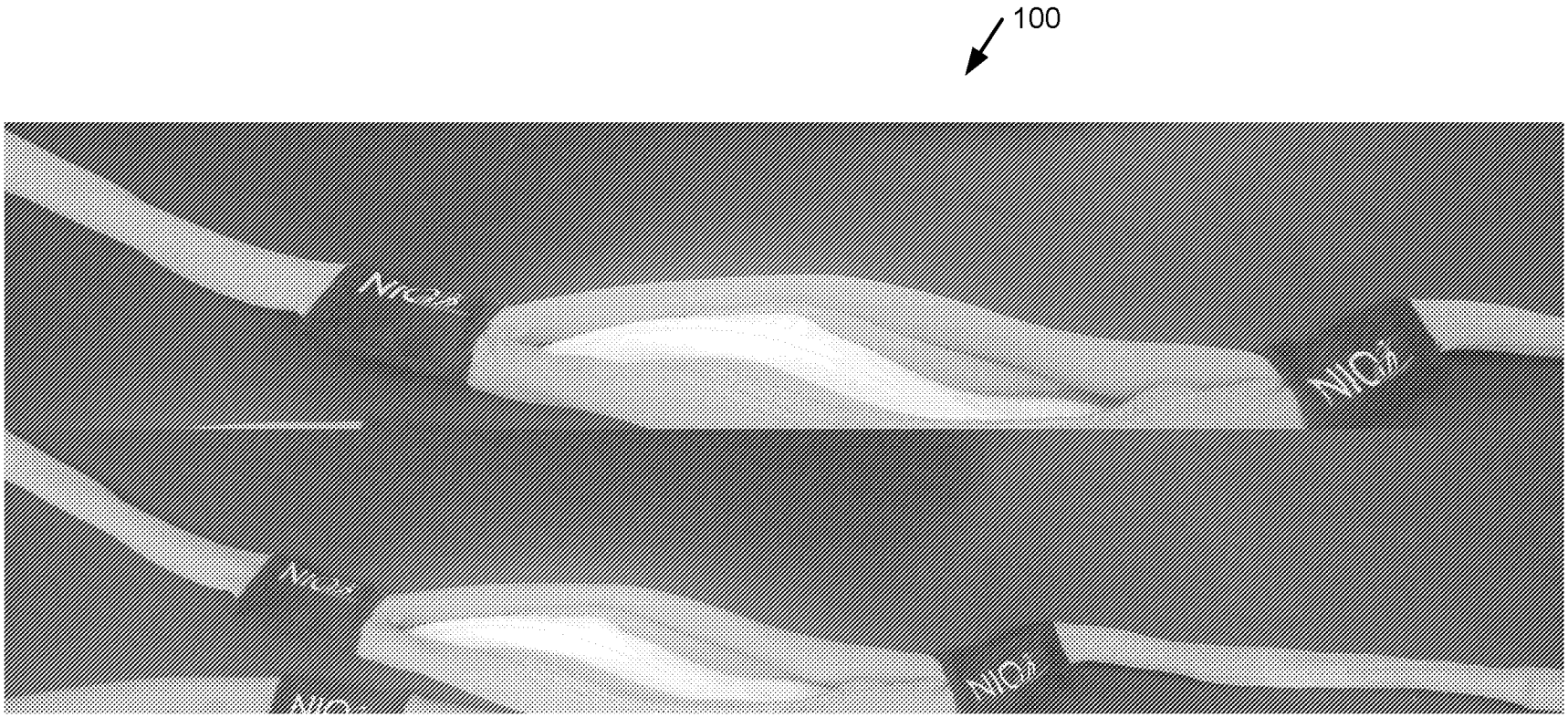
Figure 2H:
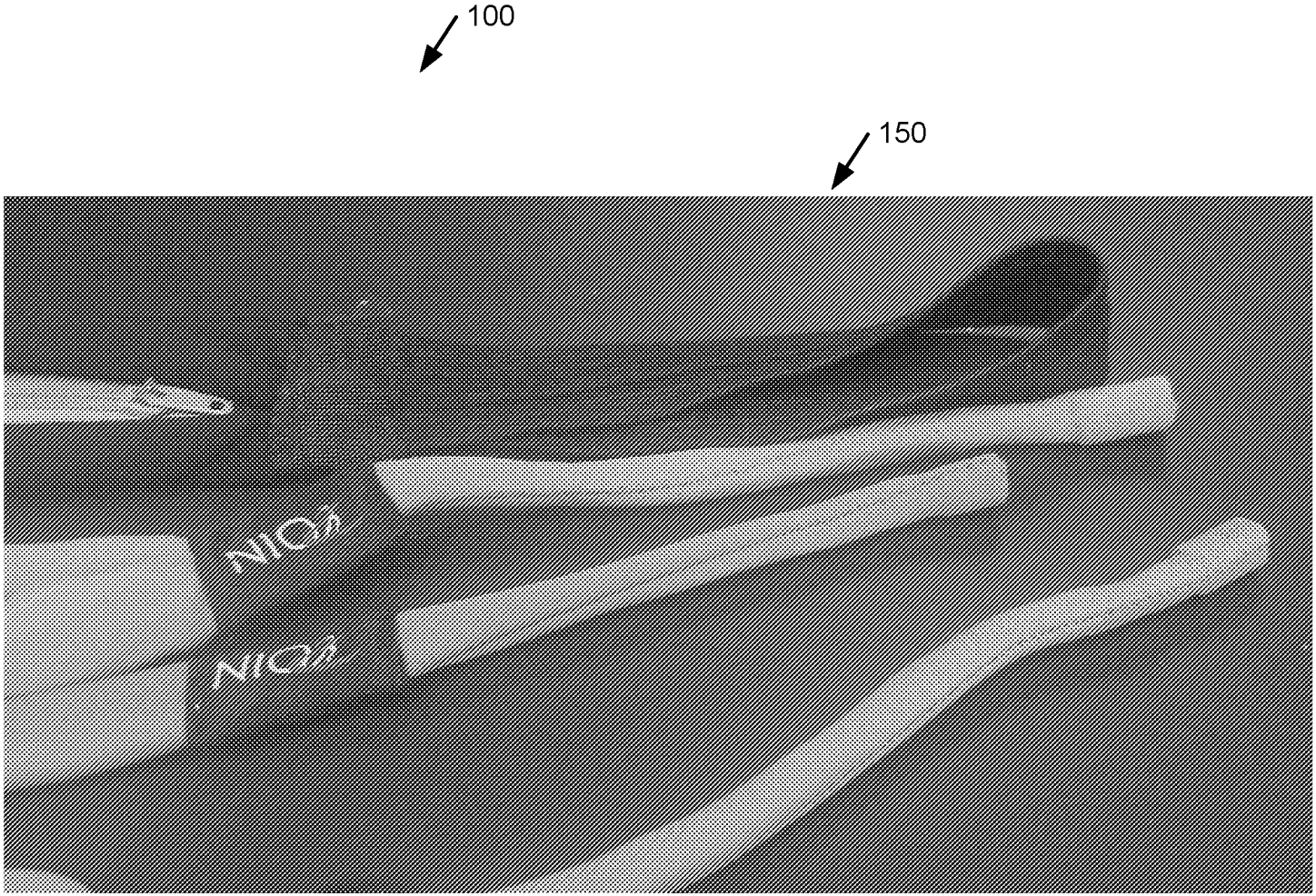
Figure 2I:
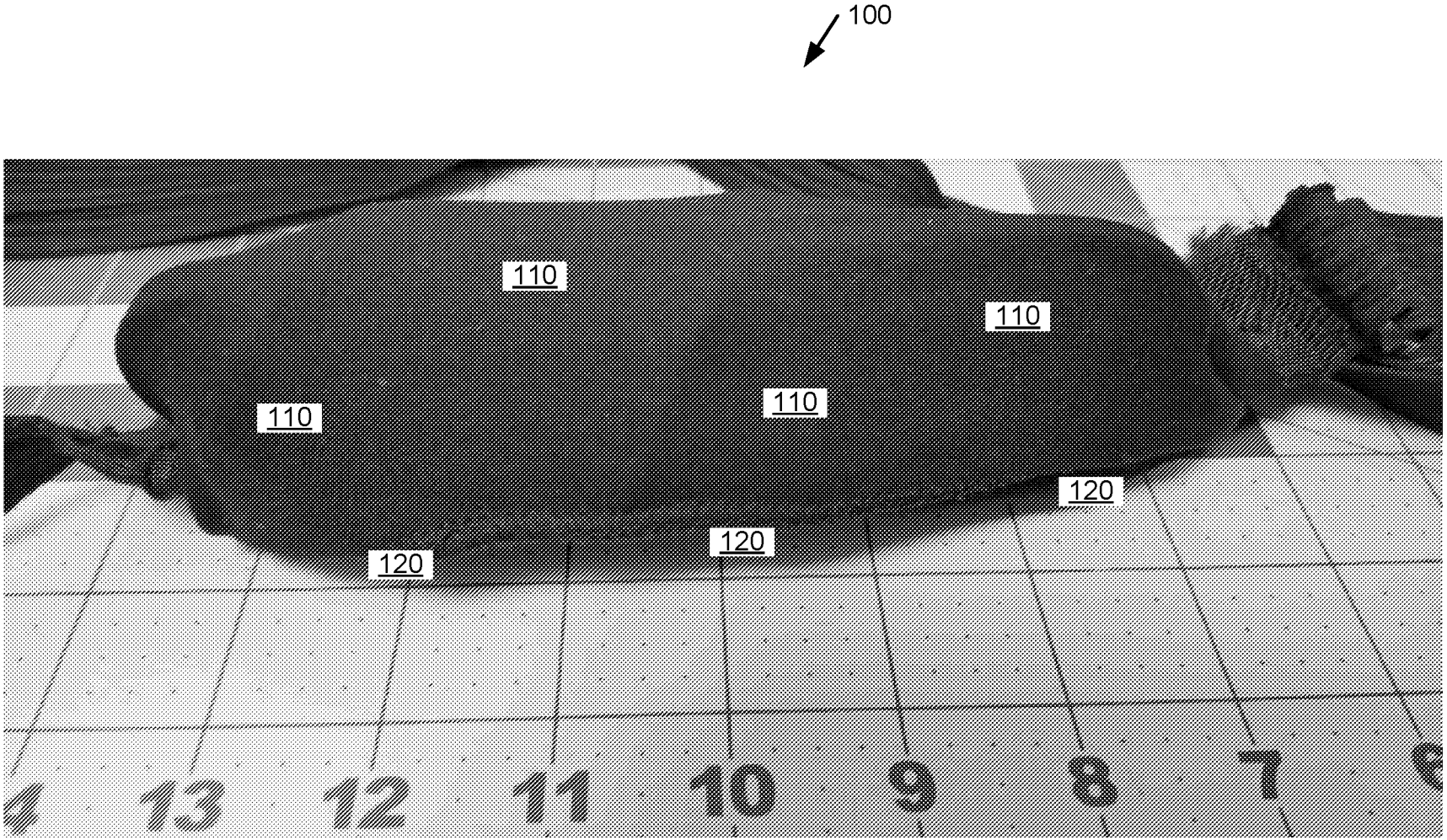
FIGS. 2I-2L illustrate various back or bottom views of the implementation of an example auto-foldable pouch according to the present disclosure.

As shown in FIGS. 2A and 2I, in some implementations, the auto-foldable pouch 100 comprises an auto-folding portion 110, an enclosing portion 120, an opening 130, and a closure ("fastener") 140. As shown in FIGS. 2D and 2H, in some implementations, the auto-foldable pouch 100 may further comprise a connector 150.

As shown in FIG. 2A, in some implementations, the auto-folding portion 110 comprises a first auto-folding edge 112, a second auto-folding edge 113, and an inner surface 114. In some implementations, the auto-folding portion 110 extends between the first auto-folding edge 112 and the second auto-folding edge 113.

As shown in FIG. 2A, in some implementations, the first auto-folding edge 112 and the second auto-folding edge 113 extend substantially parallel to the opening 130, which is described more below. In some implementations, the first auto-folding edge 112 and the second auto-folding edge 113 so extend on opposite sides of the opening 130. In some implementations, the first auto-folding edge 112 and the second auto-folding edge 113 so extend adjacent to (e.g., near to or next to) the opening 130.

As shown in FIG. 2E, in some implementations, the first auto-folding edge 112 and the second auto-folding edge 113 are configured to auto-fold (e.g., self-fold or self-compact). For example, in some implementations, the first auto-folding edge 112 and the second auto-folding edge 113 are configured to normally roll up into a compact configuration. In some implementations, the configuring of the first auto-folding edge 112 and the second auto-folding edge 113 to auto-fold thereby allows the auto-foldable pouch 100 to auto-fold, as described more below.

In some implementations, the first auto-folding edge 112 and the second auto-folding edge 113 are composed of a material that rolls up in a natural state of the material.

As shown in FIG. 2A, in some implementations, the enclosing portion 120 is attached to the inner surface 114 of the auto-folding portion 110, as described more below.

As shown in FIG. 2A, in some implementations, the auto-folding portion 110 forms a portion of the auto-foldable pouch 100 that can enclose items, as described below. In some implementations, the auto-folding portion 110 forms a back or lower portion of the auto-foldable pouch 100 that can enclose items.

In some implementations, the auto-folding portion 110 may form most of the portion of the auto-foldable pouch 100 that can enclose items. In some implementations, the auto-folding portion 110 may form a lesser portion of the auto-foldable pouch 100 that can enclose items. In some implementations, the auto-folding portion 110 may form a partial outer layer adjacent to the portion of the auto-foldable pouch 100 that can enclose items, such as the enclosing portion 120 described below.

As shown in FIG. 2A, in some implementations, the auto-folding portion 110 is configured to provide a portion of the auto-foldable pouch 100 that can enclose items, such as described above and also more below.

As shown in FIG. 2E, in some implementations, the auto-folding portion 110 is configured to allow the auto-foldable pouch 100 to auto-fold, as also described above and more below.

As shown in FIG. 2A, in some implementations, the enclosing portion 120 comprises a first section 122 and a second section 123. In some implementations, the first section 122 and the second section 123 extend respectively from a respective attachment to the inner surface 114 on opposite sides of the auto-folding portion 110.

In some implementations, the first section 122 and the second section 123 extend respectively from the inner surface 114 of the auto-folding portion 110 to opposite sides of the opening 130 of the auto-foldable pouch 100. In some implementations, the opening 130 thereby extends through the enclosing portion 120 between the first section 122 and the second section 123 of the enclosing portion 120.

In some implementations, the first section 122 and the second section 123 may be attached respectively to the inner surface 114 of the auto-folding portion 110 at any suitable position. For example, as shown in FIG. 2A, in some implementations, the first section 122 and the second section 123 may be attached to the inner surface 114 adjacent respectively to the first auto-folding edge 112 and the second auto-folding edge 113.

In some implementations, the first section 122 and the second section 123 may be attached respectively to the inner surface 114 closer to the auto-folding edges 112, 113. In some implementations, the first section 122 and the second section 123 may be attached respectively to the inner surface 114 farther from the auto-folding edges 112, 113.

In some implementations, the first section 122 and the second section 123 may be attached together respectively at the ends of the first section 122 and the second section 123 opposite from the opening 130, for example thereby forming an inner pouch separate from and at least partially within the auto-folding portion 110. In some implementations, the first section 122 and the second section 123 may be so attached in addition to or instead of being attached to the inner surface 114 of the auto-folding portion 110.

In some implementations, the first section 122 and the second section 123 may be attached to the auto-foldable pouch 100 in any other suitable configuration.

As shown in FIG. 2A, in some implementations, the fastener 140 attaches to and between the first section 122 and the second section 123 at the opening 130, as described more below.

In some implementations, the attachments described herein, such as of the first section 122 and the second section 123 respectively to the inner surface 114 or of the fastener 140 to the opening 130, may be made in any suitable manner, such as by sewing, adhesive, etc.

As shown in FIG. 2A, in some implementations, the enclosing portion 120 forms a portion of the auto-foldable pouch 100 that can enclose items, as described below. In some implementations, the enclosing portion 120 forms a front or upper portion of the auto-foldable pouch 100 that can enclose items.

In some implementations, the enclosing portion 120 may form a lesser portion of the auto-foldable pouch 100 that can enclose items. In some implementations, the enclosing portion 120 may form most of the portion of the auto-foldable pouch 100 that can enclose items. In some implementations, the enclosing portion 120 may form the portion of the auto-foldable pouch 100 that can enclose items adjacent to an at least partial outer layer of the auto-foldable pouch 100, such as formed by the auto-folding portion 110 as described above.

As shown in FIG. 2A, in some implementations, the enclosing portion 120 is configured to provide a portion of the auto-foldable pouch 100 that can enclose items, such as described above and also more below. In some implementations, the enclosing portion 120 is configured to provide such enclosing portion of the auto-foldable pouch 100 that is separate from the auto-folding portion 110 of the auto-foldable pouch 100.

As shown in FIG. 2E, in some implementations, the enclosing portion 120 is also configured to be auto-folded by the auto-folding portion 110, such as by the first auto-folding edge 112 and the second auto-folding edge 113 of the auto-folding portion 110 as described above and also more below.

In some implementations, the opening 130 comprises any suitable size. In some implementations, the opening 130 comprises any suitable shape. In some implementations, the opening 130 comprises any other suitable feature to allow items to be inserted into and removed from the auto-foldable pouch 100, as described more below.

As shown in FIG. 2A, in some implementations, the opening 130 extends through the enclosing portion 120 between the first section 122 and the second section 123 of the enclosing portion 120.

In some implementations, the fastener 140 attaches to and between the first section 122 and the second section 123 at the opening 130, as described more below.

As shown in FIG. 2D, in some implementations, the opening 130 is configured to allow items 190 to be inserted into and removed from the auto-foldable pouch 100, such as described above and also more below. In some implementations, such items 190 may comprise a cell phone and/or other typical pocket contents such as a wallet, keys, etc.

As shown in FIGS. 2B and 2C, in some implementations, the opening 130 is configured to be closed and opened by the fastener 140.

As shown in FIGS. 2B and 2C, in some implementations, the fastener 140 may comprise a zipper closure. In some implementations, the fastener 140 may comprise a hook and loop (e.g., Velcro®) closure. In some implementations, the fastener 140 may comprise any other suitable closure, fastening mechanism, etc.

As shown in FIG. 2A, in some implementations, the fastener 140 is attached to and between the first section 122 and the second section 123 at the opening 130. In some implementations, the fastener 140 is so attached such that the fastener 140 can close and open the opening 130. In some implementations, the fastener 140 is so attached such that the fastener 140 can join and separate the first section 122 and the second section 123 at the opening 130.

As shown in FIGS. 2B and 2C, in some implementations, the fastener 140 is configured to close and open the opening 130. For example, in some implementations, the fastener 140 is configured to close and open the opening 130 to allow the auto-foldable pouch 100 to securely hold and enclose items within the auto-foldable pouch 100.

In some implementations, the fastener 140 is configured to close and open the opening 130 for any other suitable purpose.

As introduced above, and shown in FIGS. 2D and 2H, in some implementations, the auto-foldable pouch 100 may further comprise a connector 150. As shown in FIG. 2D, and also in FIG. 2J, in some implementations, the connector 150 may comprise a belt. As shown in FIG. 2H, in some implementations, the connector 150 may comprise an eyeglasses strap.

In some implementations, the connector 150 may comprise any other suitable type of connector, attachment mechanism, etc.

In some implementations, the connector 150 may comprise a single component or assembly, such as a strap. In some implementations, the connector 150 may comprise two components or assemblies, such as a two-part belt. In some implementations, the connector 150 may comprise three or more components or assemblies. In some implementations, the connector 150 may comprise any other suitable component or assembly configuration.

In some implementations, the connector 150 may be attached to at least one position on the auto-foldable pouch 100, such on the auto-folding portion 110. As shown in FIG. 2D, in some implementations, the connector 150 may be attached to two positions on the auto-foldable pouch 100, such as on each side or end of the auto-folding portion 110. In some implementations, the connector 150 may be attached to three or more positions on the auto-foldable pouch 100. In some implementations, the connector 150 may be attached in any other suitable configuration to the auto-foldable pouch 100.

In some implementations, the connector 150 may be removably attached to the auto-foldable pouch 100.

In some implementations, the connector 150 may be adjustable in length or other dimension.

In some implementations, the connector 150 may be configured to allow a user to carry the auto-foldable pouch 100. In some implementations, the connector 150 may be configured to allow a user to carry the auto-foldable pouch 100 on-person, such as attached around the user's waist.

In some implementations, the connector 150 may be configured to allow a user to attach the auto-foldable pouch 100 to a pair of eyeglasses or sunglasses.

In some implementations, the connector 150 may be configured to allow a user to attach or connect the auto-foldable pouch 100 in any other suitable manner or configuration.

As shown in FIG. 2A, in some implementations, the auto-foldable pouch 100 is configured to provide an auto-foldable pouch enclosure that includes an enclosing portion 120 that is separate from the auto-folding portion 110.

As shown in FIGS. 2A-2D, in some implementations, the auto-foldable pouch 100 is configured to provide such auto-foldable pouch enclosure that includes a fastener 140 that closes an opening 130 of the pouch enclosure through the separate enclosing portion 110 to securely hold and enclose items 190.

As shown in FIGS. 2E-2F and 2K-2L, in some implementations, the auto-foldable pouch 100 is configured to auto-fold (e.g., self-fold or self-compact). For example, in some implementations, the auto-foldable pouch 100 is configured to normally roll up or otherwise fold into a compact configuration.

As shown in FIGS. 2A, 2C, and 2D, in some implementations, the auto-foldable pouch 100 is configured to allow items 190 to be inserted into and removed from the auto-foldable pouch 100, such as a cell phone and/or other typical pocket contents such as a wallet, keys, etc.

As shown in FIGS. 2B and 2C, in some implementations, the auto-foldable pouch 100 is configured to be closed by a fastener 140 to securely hold and enclose items 190 in the auto-foldable pouch 100. In some implementations, the auto-foldable pouch 100 is configured to be opened by the fastener 140 to remove the items 190 held and enclosed in the auto-foldable pouch 100.

Figure 2J:
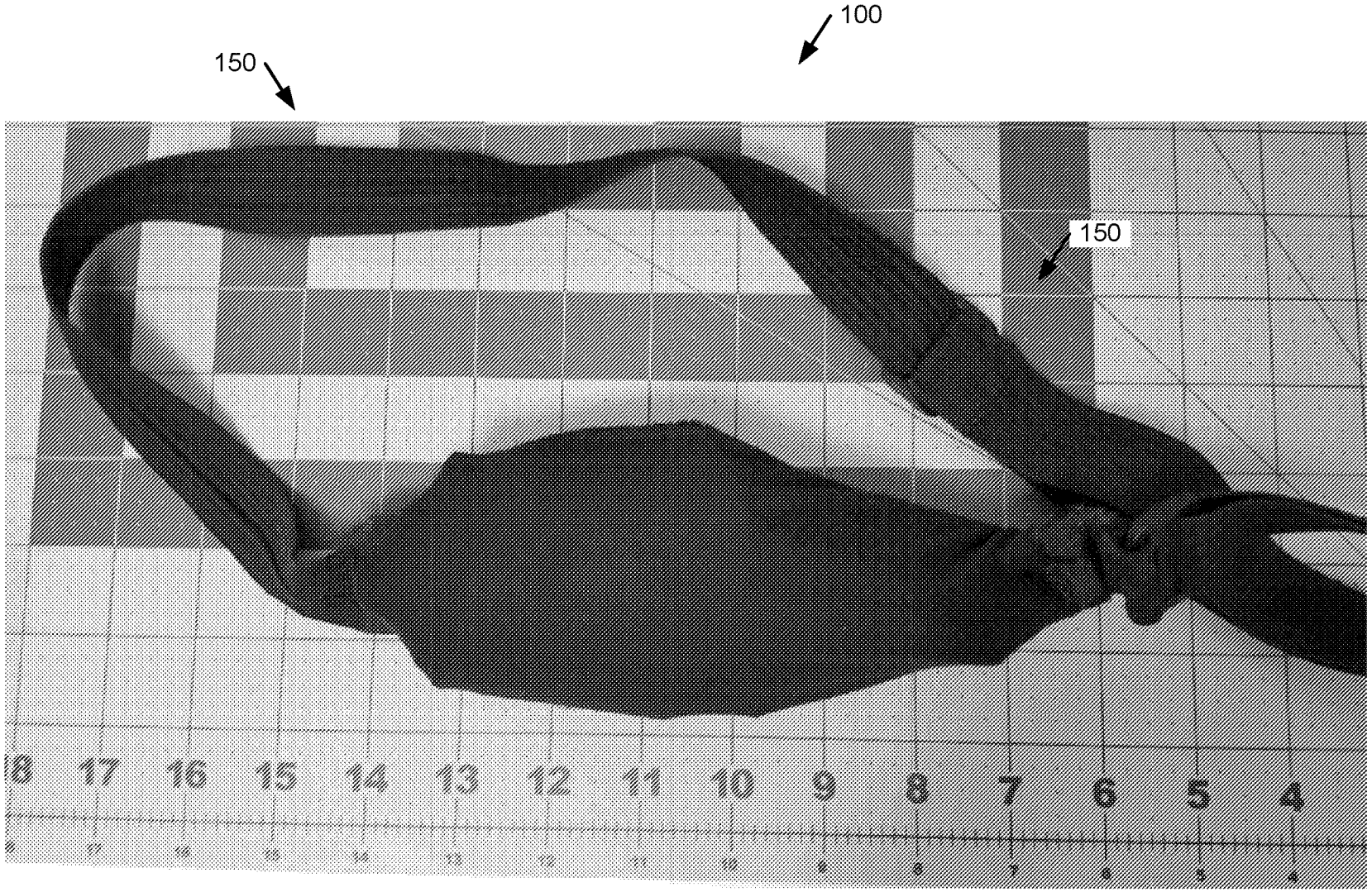

As shown in FIGS. 2D, 2H, and 2J, in some implementations, the auto-foldable pouch 100 is configured to allow a user to carry the auto-foldable pouch 100.

In some implementations, the auto-foldable pouch 100 is configured to allow a user to carry the auto-foldable pouch 100 on-person, such as attached around the user's waist.

In some implementations, the auto-foldable pouch 100 is configured to allow a user to attach the auto-foldable pouch 100 to a pair of eyeglasses or sunglasses.

In some implementations, the auto-foldable pouch 100 comprises any suitable dimensions, such as the example dimensions indicated in FIGS. 2I-2L.

In some implementations, the auto-foldable pouch 100 is composed of any suitable materials. For example, in some implementations, the auto-foldable pouch 100 is composed of a flexible material that is configured to auto-fold. In some implementations, the auto-foldable pouch 100 is composed of neoprene.

In some implementations, the auto-foldable pouch 100 can have any suitable appearance, such as the example appearances shown in the above described FIGS. 2A-2L.

Figure 2K:
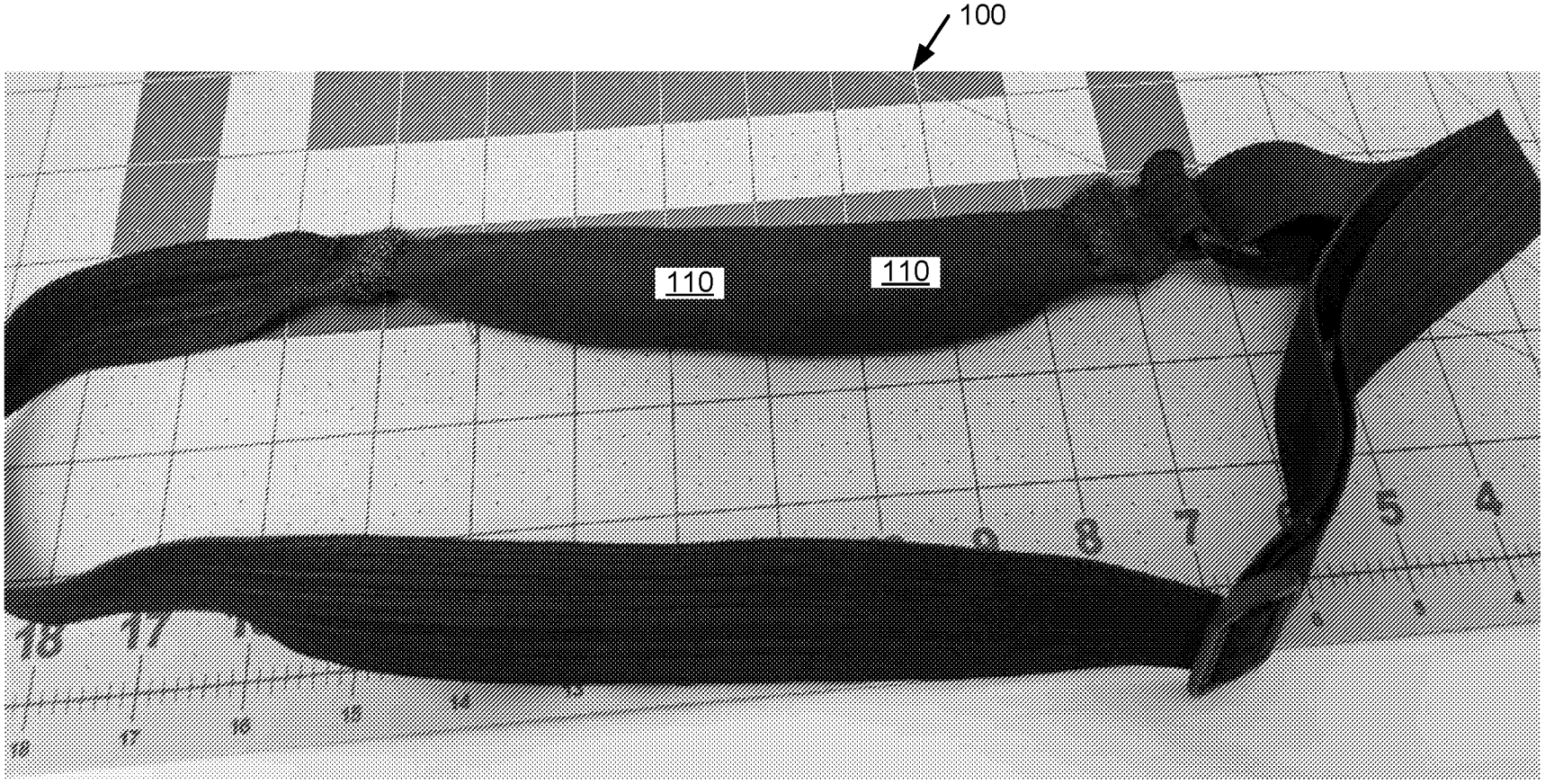
Figure 2L:
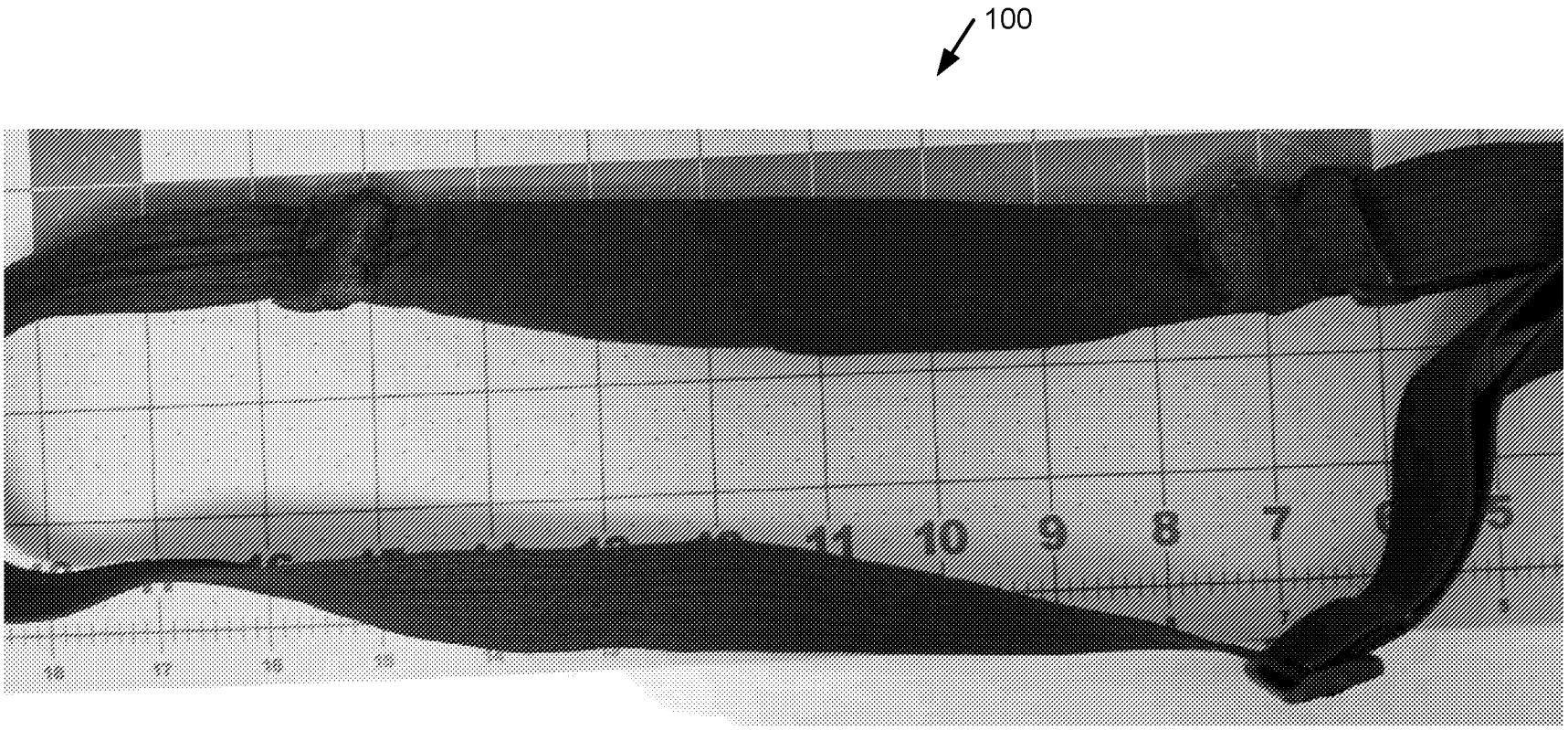
Figure 3A:
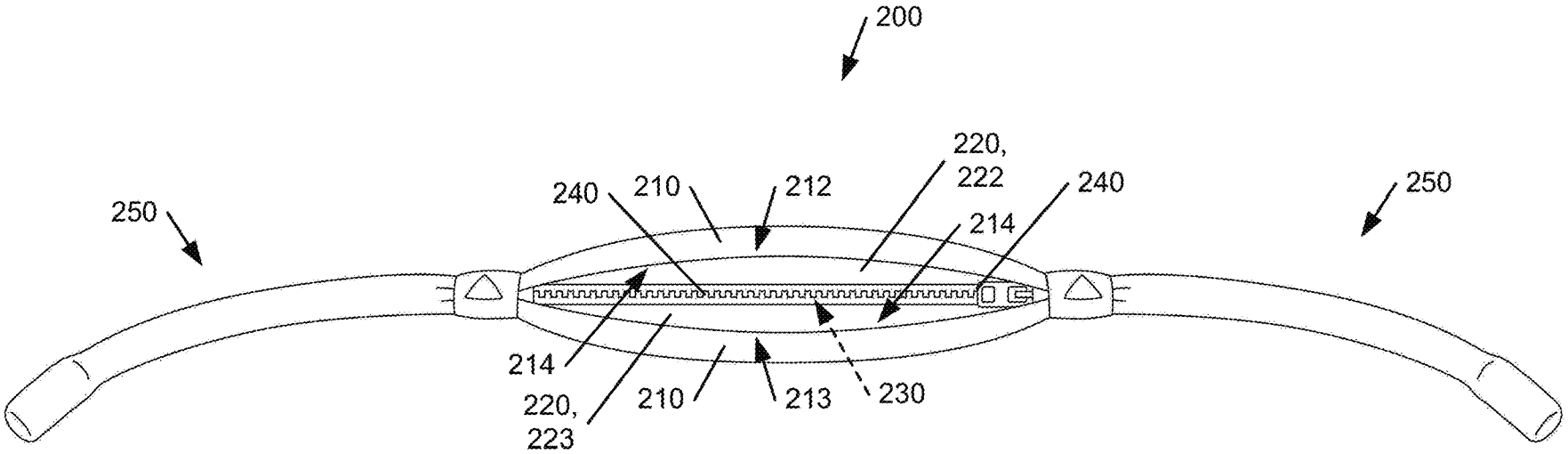
FIGS. 3A and 3B illustrate another implementation of an example auto-foldable pouch according to the present disclosure.
Figure 3B:
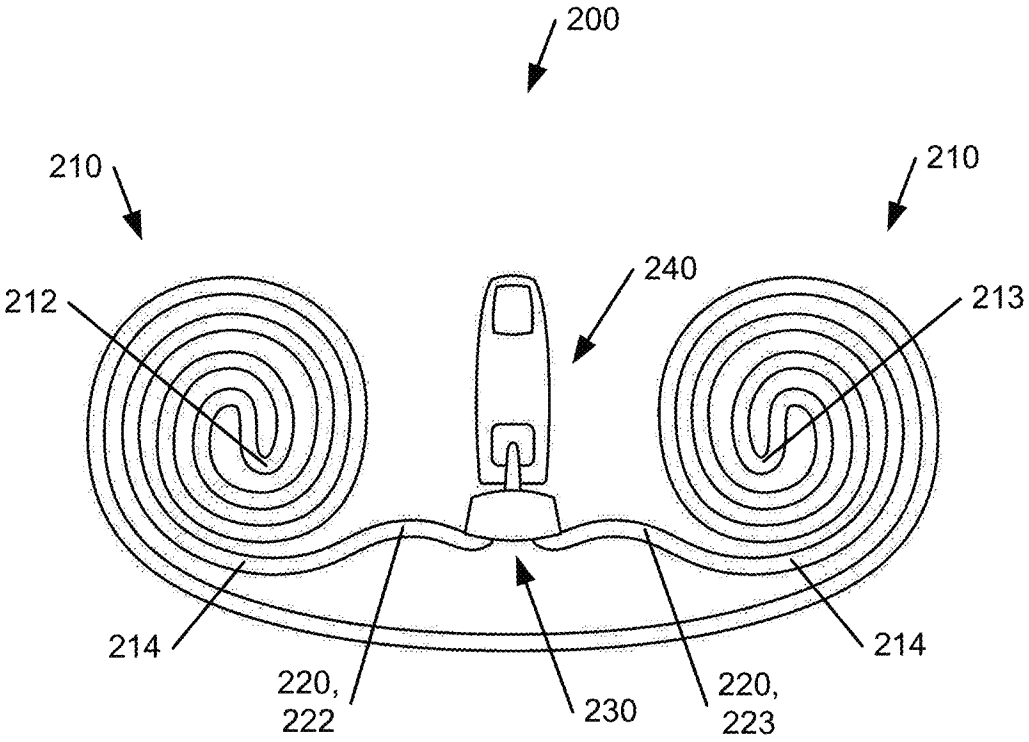

FIGS. 3A and 3B illustrate another implementation of an example auto-foldable pouch 200 according to the present disclosure. In some implementations, the auto-foldable pouch 200 is the same or similar to the above describe auto-foldable pouch 100 of FIGS. 2A-2L as indicated by like numbered features.

For example, in some implementations, the auto-foldable pouch 200 comprises an auto-folding portion 210, an enclosing portion 220, an opening 230, and a closure ("fastener") 240 that are the same or similar respectively to the above described auto-folding portion 110, enclosing portion 120, opening 130, and closure ("fastener") 140 of the auto-foldable pouch 100.

In some implementations, an example method of using the auto-foldable pouch 100, with respect to the above described FIGS. 2A-2L, comprises unrolling or otherwise unfolding the auto-foldable pouch 100 from a compact configuration, such as shown in FIGS. 2E and 2K. In some implementations, unfolding the auto-foldable pouch 100 comprises unrolling the first auto-folding edge 112 and the second auto-folding edge 113 of the auto-folding portion 110 to access the enclosing portion 120, fastener 140, and/or opening 130.

In some implementations, the method comprises opening the auto-foldable pouch 100 for the insertion of one or more items 190 into the auto-foldable pouch 100. In some implementations, opening the auto-foldable pouch 100 comprises opening the opening 130 through the enclosing portion 120 with the fastener 140, such as shown in FIGS. 2A and 2C.

In some implementations, the method comprises inserting one or more items 190 into the auto-foldable pouch 100 through the opening 130, such as shown in FIG. 2D. In some implementations, the items 190 are inserted into the pouch enclosure formed by the auto-folding portion 110 and the enclosing portion 120.

In some implementations, the method comprises closing the auto-foldable pouch 100 to securely hold and enclose the items 190 in the auto-foldable pouch 100. In some implementations, closing the auto-foldable pouch 100 comprises closing the opening 130 with the fastener 140, such as shown in FIG. 2B.

In some implementations, the method further comprises allowing the auto-foldable pouch 100 to partially auto-fold to cover the fastener 140 and/or to compact an empty portion of the auto-foldable pouch 100 while holding the items 190. In some implementations, allowing the auto-foldable pouch 100 to partially auto-fold comprises allowing the first auto-folding edge 112 and the second auto-folding edge 113 of the auto-folding portion 110 to roll up at least partially over the enclosing portion 120 and/or the fastener 140.

In some implementations, the method further comprises carrying the auto-foldable pouch 100 containing the items 190 with the connector 150. In some implementations, carrying the auto-foldable pouch 100 comprises attaching the auto-foldable pouch 100 around a user's waist with the connector 150. In some implementations, carrying the auto-foldable pouch 100 comprises attaching the auto-foldable pouch 100 to a pair of eyeglasses or sunglasses with the connector 150.

In some implementations, the method further comprises unfolding and opening the auto-foldable pouch 100 as described above to remove the items 190 from the auto-foldable pouch 100 through the opening 130.

In some implementations, the method further comprises closing the emptied auto-foldable pouch 100 and allowing the auto-foldable pouch 100 to auto-fold as described above. In some implementations, the emptied auto-foldable pouch 100 is allowed to auto-fold into a fully compact configuration, such as shown in FIGS. 2E and 2K.

In some implementations, an example method of using the auto-foldable pouch 200 of FIGS. 3A and 3B is the same or similar to the above described method of using the auto-foldable pouch 100 of FIGS. 2A-2L.

The figures, including photographs and drawings, comprised herewith may represent one or more implementations of the auto-foldable pouch.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. An auto-foldable pouch comprising:

an auto-foldable portion and a closure portion that form a pouch enclosure that can receive and hold an item, wherein:

the auto-foldable portion comprises a first piece of material extending lengthwise between a first side and a second side and extending widthwise between a third side having an outermost edge and a fourth side having an outermost edge, wherein the first piece of material is configured to auto-fold such that the third side and the fourth side roll inwardly toward each other when not forced apart; and the closure portion comprises a second piece of material extending lengthwise between a first side and a second side and extending widthwise between a third side having an outermost edge and a fourth side having an outermost edge, wherein the second piece of material comprises a recloseable opening wherein the outermost edges on the third and fourth sides of the second piece of material are attached to and extend from the auto-foldable portion a distance away from the outermost edges on the third and fourth side of the first piece of material such that the third side and fourth side of the first piece of material are on opposite sides of the recloseable opening and wherein the closure portion is positioned above the auto-foldable portion such that the auto-foldable portion and the closure portion form the pouch enclosure between the auto-foldable portion and the closure portion and wherein the recloseable opening of the closure portion is configured to open such that an item may pass through the opening and the recloseable opening of the closure portion is configured to close to enclose the item in the pouch enclosure for storage.

2. The auto-foldable pouch of claim 1 wherein recloseable opening is formed from a zipper.

3. The auto-foldable pouch of claim 1 further comprising a belt is attached to the first side and second side of the auto-foldable portion.

4. The auto-foldable pouch of claim 1 wherein the auto-foldable pouch is composed of a neoprene material.

5. A method of using the auto-foldable pouch of claim 1 comprising:

at least partially unrolling the third end and the fourth end of the auto-foldable portion to access the closure portion; and placing an item through the recloseable opening of the closure portion into the pouch enclosure.

6. The method of claim 5 further comprising closing the recloseable opening of the closure portion.

7. The method of claim 5 wherein the item comprises a mobile phone.

8. The method of claim 5 wherein the item comprises a pair of eyeglasses.

9. A method of using the auto-foldable pouch of claim 3 comprising:

at least partially unrolling the third end and the fourth end of the auto-foldable portion;

placing an item through the recloseable opening of the closure portion into the pouch enclosure;

closing the recloseable opening of the closure portion; and attaching the auto-foldable pouch to a user using the belt.

* * * * *